US005535464A

United States Patent [19]

Salonica

[11] Patent Number: 5,535,464

[45] Date of Patent: Jul. 16, 1996

[54] SECTIONAL INVALID BED WITH DISPOSABLE WASTE CONTAINER

[76] Inventor: Frank T. Salonica, 41581 Rte. 39, Wellsville, Ohio 43968

[21] Appl. No.: 160,672

[22] Filed: Dec. 2, 1993

[51] Int. Cl.[6] ..... A61G 7/02; A61G 7/015

[52] U.S. Cl. ..... 5/604; 5/618

[58] Field of Search ..... 5/604, 618, 613, 5/463, 617

[56] References Cited

U.S. PATENT DOCUMENTS

| | | | |
|---|---|---|---|
| 554,580 | 2/1896 | Conkwright | 5/618 |
| 801,667 | 10/1905 | Kinz | 5/604 |
| 2,872,689 | 2/1959 | Fournet | 5/604 |
| 3,849,811 | 11/1974 | Cyll | 5/604 |
| 3,921,234 | 11/1975 | Mracek et al. | 5/604 |
| 4,225,988 | 10/1980 | Cary et al. | 5/618 |
| 4,307,477 | 12/1981 | Jacobsen | 5/618 |
| 4,754,508 | 7/1988 | Nishiguchi | 5/604 |
| 4,847,929 | 7/1989 | Pupovic | 5/604 |
| 5,125,122 | 6/1992 | Chen | 5/618 |
| 5,303,437 | 4/1994 | Hung | 5/613 |

*Primary Examiner*—Alexander Grosz
*Attorney, Agent, or Firm*—Harpman & Harpman

[57] ABSTRACT

An invalid bed for use in hospitals and the like for invalids or bed-ridden patients to provide multiple adjustment mattress configurations. A segmented mattress support is positioned on a multi-sectioned platform on a bed frame with longitudinal and transversely divided lift elements selectively elevating a headrest portion and/or leg portion transversely in relation to the bed or longitudinally, both portions along its central axis. The portion of the mattress and its support is apertured to accept a disposable bed pan which extends below the bed.

5 Claims, 2 Drawing Sheets

SECTIONAL INVALID BED WITH DISPOSABLE WASTE CONTAINER

BACKGROUND OF THE INVENTION

1. Technical Field

The present invention relates to hospital beds that can be adjusted to elevate portions of the mattress as well as being equipped with internal disposable bed pan configurations.

2. Description of the Prior Art

Prior art devices of this type have relied on a number of different configurations to elevate and adjust a special mattress equipped bed with is equipped with a toilet or bed pan construction below the bed so that the patient can easily be positioned thereon. See for example U.S. Pat. Nos. 2,872,689, 4,307,477, 4,754,508 and 4,847,929.

In U.S. Pat. No. 2,872,689 a hospital bed with laterally adjustable sections is shown wherein two adjustable spring sections can be moved on a support track to reveal access to a bed pan positioned therebelow the collection of human waste.

U.S. Pat. No. 4,307,477 is directed towards a bedding arrangement that uses a pair of adjacent pivoted mattress support frames that can be raised from respective opposing sides selectively elevating the head portion or the leg portion of the two-piece mattress.

A third elevation can be achieved by a secondary pivot frame with the head portion that elevates the person for access to a bed pan positioned on the remaining non-elevated portion.

U.S. Pat. No. 4,754,508 is directed to an adjustable mattress support with an internal bed pan movable between a horizontal position and a tilt position for access to multiple waste receiver compartments positioned on a rotating table beneath the bed.

A bed with adjustable portions is disclosed in U.S. Pat. No. 4,847,929 having a system of hydraulic cylinders to permit the tilting of the bed portions pivoted to a central support frame and to one another.

SUMMARY OF THE INVENTION

An adjustable hospital bed having an apertured section to receive a self-contained disposable waste receiving container. A multiple segmented mattress and mattress support platform configuration can be elevated both transversely in three traditional segmented areas as well as longitudinally joining multiple support areas together to move the patient by rolling to be positioned on and off the waste integrated waste receiving container.

DESCRIPTION OF THE PREFERRED EMBODIMENT

Figure 1:
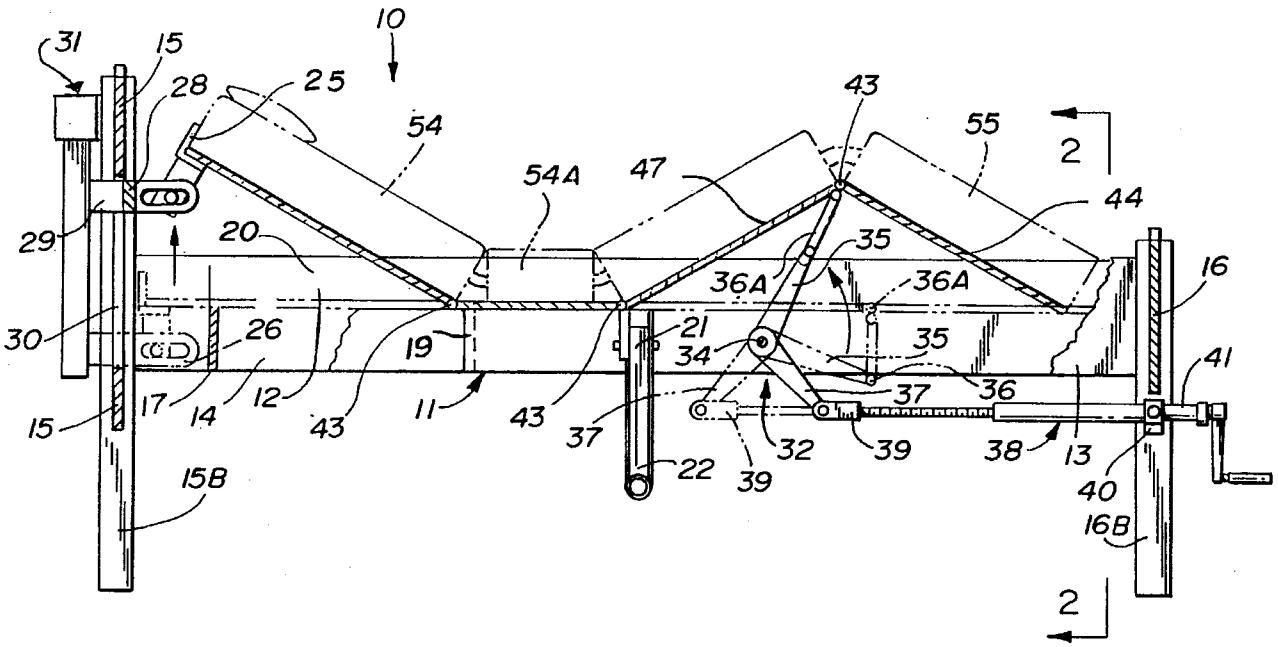
FIG. 1 is a side plan view of the bed with portions broken away illustrating both normal and elevated positions indicated in solid and broken lines.
Figure 2:
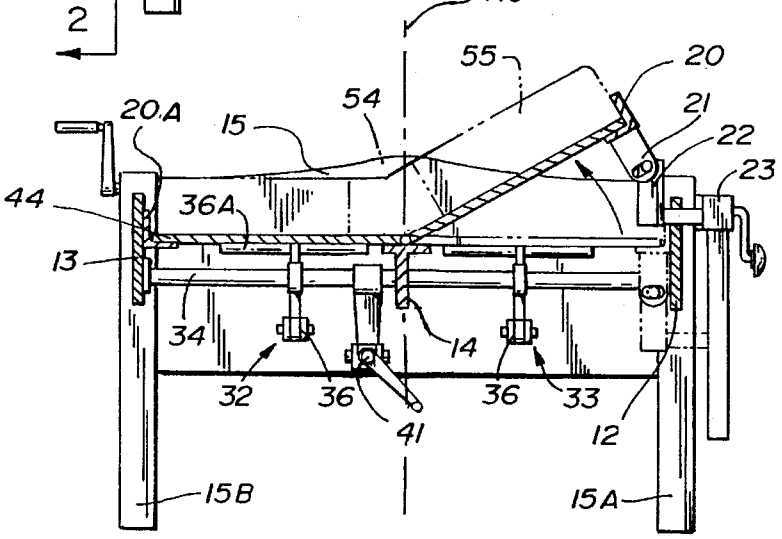
FIG. 2 is a sectional view on lines 2—2 of FIG. 1.
Figure 3:
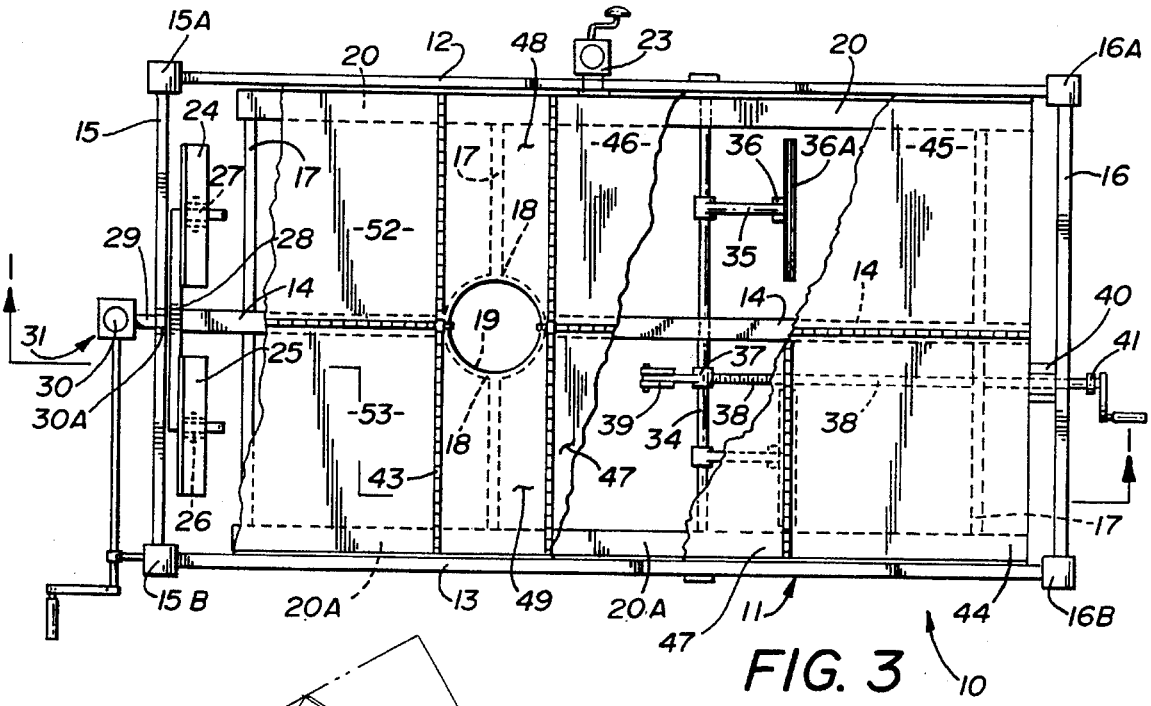
FIG. 3 is a top plan view of the bed with portions broken away for illustration purposes.

Referring to FIGS. 1–3 of the drawings, an adjustable bed 10 can be seen having a main support frame 11. The main support frame 11 is comprised of spaced parallel frame members 12 and 13 and a parallel central support frame member 14, all of which are secured to a headboard 15 with internal legs 15A and 15B and a footboard 16 with internal legs 16A and 16B at their respective opposing free ends as will be well known to those skilled in the art.

Multiple inner connecting frame support elements 17 extend transversely between said respective frame members 12 and 13 and said central support member 14 defining a support grid. Two of said transverse frame elements 17 are foreshortend at 18 and intersect a circular support element 19 positioned therebetween which also intersects said center support member 14 as best seen in FIG. 3 of the drawings in dotted lines. An elongated elevational angle 20 is movably positioned adjacent said respective frame member 12 by a central pivoted support bracket 21. The support bracket 21 is attached to a vertically movable arm assembly 22 interconnected to a driven attachment rod and crank assembly 23 as will be well known and understood by those skilled in the art.

A pair of secondary elevational angles 24 and 25 are positioned in spaced longitudinally aligned relationship adjacent said headboard 15 on either side of said central support member 14 heretofore described. Each of said secondary elongated angles 24 and 25 are adjustably secured to slotted bifurcated vertical support arms 26 and 27 respectively, as best seen in FIG. 1.

The arms 26 and 27 extend from an interconnecting bracket 28 therebetween having a centrally positioned mounting tab 29 extending at right angles therefrom. The mounting tab 29 extends through a vertical slot at 30A in the headboard 15 and is secured to a central vertically aligned drive rod 30 that can be advanced along its vertical axis by a crank activated drive mechanism 31 as best seen in FIGS. 1–3 of the drawings.

A pair of spaced aligned central elevational armature assemblies 32 and 33 are positioned respectively between said frame members 12 and 13 and the central support member 14. Each of the armature assemblies 32 and 33 are secured to a drive and support rod 34 extending transversely between and through said support frame members 12 and 13 and central support member 14 hereinbefore described.

Each of said elevational armature assemblies 32 and 33 is comprised of a drive lever 35 keyed to said drive and support rod 34 having a bifurcated apertured fitting 36 on its free end.

A T-shaped bed engagement member 36A is pivotally secured to said fitting 36 and allows for full arcuate movement as the T-shaped bed engagement member 36A is advanced vertically.

The drive and support rod 34 is rotated on its longitudinal axis by an actuator arm 37 secured thereto. Said actuating arm 37 is in turn pivotally secured to a telescopically extensible rod assembly 38 by an apertured fitting 39. The rod assembly 38 extends from said apertured fitting 39 through said foot board 16 via an aperture at 40. A crank and handle assembly 41 is attached to said rod assembly 38 so that upon rotation of the same the rod assembly 38 extends outwardly along its longitudinal axis by the nature of its screw thread configuration thus moving the actuator rod 37 which in turn rotates the support rod 34 and attached drive levers 35 in an arcuate path as defined by directional arrows as best seen in FIG. 1 of the drawings.

Figure 4:
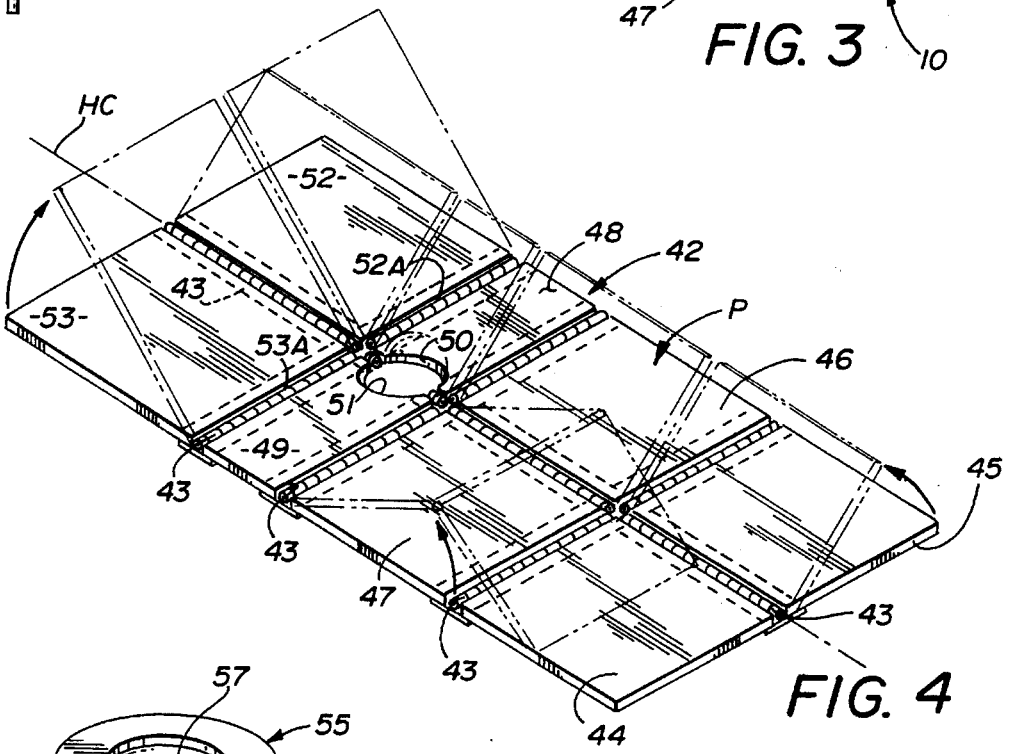
FIG. 4 is a perspective view of the support platform in solid lines and illustrating the various elevational position of the platforms in broken lines.

Referring now to FIGS. 3 and 4 of the drawings, a multiple segmented mattress support platform assembly 42 can be seen in which flat rigid platforms are continuously hinged together adjacent their respective abutting edges by hinges 43.

A first set of generally square platform elements 44 and 47 extend from said footboard 16 and are supported by said elevational angle 20, said central support member 14 and a fixed platform support elongated angle 20A secured to said frame member 13 in oppositely disposed relation to said hereinbefore described elongated elevational angle 20 as best seen in FIGS. 2 and 3 of the drawings. The platform elements 44 and 48 are hinged independently to one another as described so as to allow for both transverse and longitudinal hinge movement therebetween.

A second set of support platform elements 48 and 49 extend from said first set being rectangular in configuration with opposing arcuate notches at 50 and 51 therein defining a circular opening therebetween.

A third set of support platform elements 52 and 53 can be seen secured to said second set of support platforms and each other along their abutting surfaces 53A and 52A by the hinge elements 43 as hereinbefore described.

In operation, the respective support platform sets can be hinged along their transverse hinges 43 by the respective engagement of said elevational armature assemblies 32 and 33 in said first platform set as seen in FIG. 1 and alternately or simultaneously by said secondary elevational angles 24 and 25 in support pivoting engagement with said third support platform set 52 and 53 elevating the same by the hinge access interconnecting said second and third support platform sets again seen in FIG. 1 and illustrated by broken lines in FIG. 4 of the drawings.

Referring now to FIG. 2 of the drawings, the platform sets can all be simultaneously elevated along their perimeter edge so as to pivot along a longitudinal hinged center line HC by engagement and elevation with the elongated elevational angle 20 as hereinbefore described.

Figure 5:
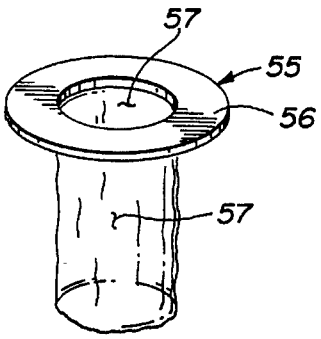
FIG. 5 is a perspective view of a disposable waste container for use within the bed invention.

A multiple hinged segment mattress 54 is illustrated in broken lines in FIGS. 1 and 2 and is segmented along the hinged lines of said multiple support platform assembly 42 with the inclusion of a removable circular tapered mattress plug 54A positioned over the circular support element 19 within the secondary support platform segments 48 and 49. The circular mattress plug 54A can be removed and a disposable waste container 55 seen in FIG. 5 of the drawings can be inserted within the opening for use by bedridden patients. The waste container 55 has a semi-rigid circular flange 56 defining a support collar engageable over the adjacent segmented mattress portions with an interconnected collapsible thin wall cylindrical bag 57 extending therefrom.

Both the circular flange 56 and the bag 57 are preferably made of synthetic resin material and are designed for one-time use only.

Thus it will be seen that a multiple adjustable self-contained invalid bed has been illustrated and described which allows for multiple mattress elevation, both transversely across the bed as well as longitudinally, and has the inclusion of an integral waste container which can be selectively positioned within an aperture formed by removal of a mattress plug so as to provide ease of use to bedridden patients which can be maneuvered on the bed by activation of elevational mechanisms hinging the segmented mattress along a longitudinal axis pivot line.

It will therefore be apparent to those skilled in the art that various changes and modifications may be made therein without departing from the spirit of the invention, and having thus described my invention what I claim is:

1. A multiple position invalid bed 10 comprising; a main support frame 11, multiple segmented support platform elements 44–48 and 52 and 53 within said main support frame 11, multiple elevation angles 20, 24, 25 movable secured to said main support frame engageable in portions of said segmented support platform elements, a bed engagement member 36A and a drive lever 35 for selective movement of said engagement support platform elements, means for advancing said drive lever 35 and said engagement member 36A, a segmented mattress 54 on said segmented support platform elements, said segmented platform support elements being pivotally secured to one another defining first 44–47, second 48 and 49 and third platform sets 52 and 53 respectively, aligned openings 50 and 51 in said second platform set, 48 and 49 and said mattress 54, means for moving said multiple elevational angles independently, disposable waste container 55 selectively registerable within aligned openings 50 and 51 in said second platform set 48 and 49 and said segmented mattress 54.

2. The multiple position invalid bed 10 of claim 1 wherein said main support frame 11 comprises spaced parallel frame members 12 and 13, a headboard 15 and a footboard 16 and a central support element 14 extending therebetween, multiple interconnected frame elements 17 interengaging said central support element 14 and said frame members 12 and 13.

3. A multiple position invalid bed 10 of claim 1 wherein said means for advancing said drive lever 35 comprises a telescopically extensibly screw rod assembly 38 interengaging said drive lever 35 for advancement thereby.

4. The multiple positioned invalid bed 10 of claim 1 wherein said disposable waste container 55 comprises; a circular flange 56 defining an opening therein, a collapsible bag 57 extending from said circular flange and aligning with said opening therein.

5. The multiple position invalid bed 10 of claim 1 wherein said multiple segmented support platform elements are hinged to one another along adjacent edges for both transverse and longitudinal pivoted movement in relation to one another.

* * * * *